US006398456B1

(12) United States Patent
Williams et al.

(10) Patent No.: US 6,398,456 B1
(45) Date of Patent: Jun. 4, 2002

(54) W-BEAM DECK DRAIN

(75) Inventors: John P. Williams, 2411 Kirby Rd., Rowlett, TX (US) 75088; Dean C. Alberson, Bryan, TX (US); D. Lance Bullard, Jr., Bryan, TX (US); Christopher J. Karpathy, Bryan, TX (US)

(73) Assignee: John P. Williams, Rowlett, TX (US)

( * ) Notice: Subject to any disclaimer, the term of this patent is extended or adjusted under 35 U.S.C. 154(b) by 0 days.

(21) Appl. No.: 09/644,808

(22) Filed: Aug. 23, 2000

(51) Int. Cl.[7] ..... E01D 19/12

(52) U.S. Cl. ..... 405/46; 405/43; 14/73; 52/220.4

(58) Field of Search ..... 14/73; 405/36, 405/43, 45, 46; 210/291, 293; 52/220.3, 220.4, 630, 783.11, 783.19, 792.1, 792.11, 796.1, 674, 220.1

(56) References Cited

U.S. PATENT DOCUMENTS

| | | | | | |
|---|---|---|---|---|---|
| 2,116,886 | A | * | 5/1938 | Goetz | 52/220.3 |
| 3,394,514 | A | * | 7/1968 | Lindner | 52/332 |
| 3,426,492 | A | * | 2/1969 | Fork | 52/783.19 |
| 3,812,636 | A | * | 5/1974 | Albrecht et al. | 52/630 |
| 3,886,702 | A | * | 6/1975 | Fork | 52/221 |
| 3,943,589 | A | * | 3/1976 | Pedersen | 14/73 |
| 4,178,469 | A | * | 12/1979 | Fork | 52/221 |
| 4,245,924 | A | | 1/1981 | Fouss et al. | 405/45 |
| 4,453,349 | A | * | 6/1984 | Ryan | 52/630 |
| 4,453,364 | A | * | 6/1984 | Ting | 52/630 |
| 4,454,692 | A | * | 6/1984 | Ault | 52/221 |
| 4,465,897 | A | * | 8/1984 | Albrecht | 52/221 |
| 4,593,506 | A | * | 6/1986 | Hartman et al. | 52/221 |
| 4,603,523 | A | * | 8/1986 | Albrech et al. | 52/221 |
| 4,630,414 | A | * | 12/1986 | Ting | 52/220 |
| 4,726,159 | A | * | 2/1988 | Stohs | 52/630 |
| 4,837,994 | A | * | 6/1989 | Stohs | 52/221 |
| 5,118,419 | A | * | 6/1992 | Evans et al. | 210/291 |
| 5,123,777 | A | * | 6/1992 | Tadros | 14/73 |
| 5,275,506 | A | | 1/1994 | Grimsley | 405/43 |
| 5,332,497 | A | * | 7/1994 | Shea et al. | 210/293 |
| 5,618,426 | A | | 4/1997 | Eischen et al. | 210/541 |

OTHER PUBLICATIONS

Internet address http://www.contech–cpi.com/ for Contech Construction Products.

* cited by examiner

*Primary Examiner*—Robert E. Pezzuto
*Assistant Examiner*—Alexandra K. Pechhold
(74) *Attorney, Agent, or Firm*—Richard K. Huffman; James W. Huffman

(57) ABSTRACT

A deck drain apparatus is provided that allows builders to inexpensively configure deck drainage systems from standard AASHTO M180 highway guardrail. The apparatus includes a number of deck drain sections, butted together to form a drain channel. Each of the drain sections consists of a pan section and an inverted W-beam section. The pan section has a longitudinally elongated and flat conducting surface and two perforated sides. The two perforated sides project upwardly along opposite lateral edges of the conducting surface. The inverted W-beam section has a first perforated wall, a first upper surface, a lower surface, a second upper surface, and a second perforated wall. The perforated walls are longitudinally elongated and formed along opposite lateral edges of the inverted W-beam section. The first upper surface is formed between the first perforated wall and the lower surface. The second upper surface is formed between the lower surface and the second perforated wall. The inverted W-beam section is inserted into the pan section, creating friction bonds between the first perforated side and the first perforated wall, and between the second perforated side and the second perforated wall.

24 Claims, 5 Drawing Sheets

*W-Beam Deck Drain Installation (Cross-Sectional View)*

*Typical Hemi-Cylindrical Deck Drain Installation (Cross-Sectional View)*

W-Beam Deck Drain End View

W-Beam Section Plan View

W-Beam Section Side View

W-Beam Cross-Sectional View

Unfolded Drain Pan Section Plan View

Folded Drain Pan Section Plan View

Folded Drain Pan Section Side View

Folded Drain Pan Section Cross-Sectional View

W-Beam Deck Drain Installation (Cross-Sectional View)

W-BEAM DECK DRAIN

BACKGROUND OF THE INVENTION

1. Field of the Invention

This invention relates in general to the field of drainage systems and more particularly to a deck drain apparatus.

2. Description of the Related Art

In many instances it is desirable to prevent excess water from pooling or standing in certain areas. For example, virtually all residential and commercial buildings utilize some form of gutter to collect water from roof structures and to transport that water to some other location. For structures having flat roofs, it is often satisfactory to merely transport the water off of the roof itself. For other structures, additional drainage must be provided at the ground level to transport the collected water away from the building foundations.

Drainage systems can be used in above ground applications, to include guttering, agricultural ditch systems, and free-standing drains. Drainage apparatus is also employed below the surface in the form of culverts and deck drains for bridges, roadways, railways, walkways, and other transportation surfaces along which water is to be precluded from pooling.

A "deck" is the base of a transportation surface that most often provides the structural integrity needed for a structure. In the case of a railway bridge structure, the bridge deck is typically a flat concrete surface. Walls are placed on the outside of the deck to form a cavity into which a ballast material is backfilled. The railroad track itself floats on top of the ballast material, thus providing for expansion and contraction under weather extremes and also providing a means for insulating the rigid deck surface against the severe mechanical vibrations caused by passing trains.

To keep water from pooling on the surface of a deck, builders locate perforated deck drains along the low edges of a deck surface-much like gutters are placed on the eves of a roof-that provide a means for collecting the water and for transporting it to a downspout or dumping area. The primary difference between gutters and deck drains is that deck drains are most often located beneath a ballast material. Thus, deck drains have perforated top portions that allow water to enter the drainage channel while ballast material is kept outside the drainage channel.

Consequently, deck drains must be strong enough to withstand the compressive forces of ballast. In addition, since they are frequently located below the surface, they must be treated to resist corrosion.

A number of different drain systems have been developed over the years that satisfy the two above-noted criteria, however, these drain systems provide other special-purpose capabilities as well. For example, Grimsley (U.S. Pat. No. 5,275,506) teaches an improved railway deck drainage system that is electrically non-conductive. To achieve this desirable property, costly synthetic resin material is recommended for fabrication. Alternatively, Fouss (U.S. Pat. No. 4,245,924) discloses a technique for fabricating a drain that can be folded for shipment. Yet, to provide for a foldable upper part that will not compress under the weight of normal ballast, Fouss teaches the use of a corrugated plastic material having a complex and non-uniform cross-section. Thus, even though these special-purpose characteristics may be desirable under certain applications, the fabrication of deck drain sections that exhibit such features requires the use of complex materials, or tooling, or fabrication processes, thus significantly increasing the overall cost of providing drainage. One skilled in the art will appreciate that more often than not builders encounter drainage applications requiring an inexpensive drain that is obtainable, durable, and which will withstand the compressive forces of backfilled ballast.

Therefore, what is needed is a deck drain apparatus that can be inexpensively produced.

In addition, what is needed are deck drain sections that can be made from readily available material such as standard highway W-beam guardrail.

Furthermore, what is needed is a technique for providing deck drains that allows builders to modify readily available highway-guardrail material in lieu of more costly materials to form a perforated upper drain surface.

SUMMARY

Accordingly, it is a feature of the present invention to provide a deck drain apparatus. The deck drain includes a pan section and a guardrail. The pan section has an essentially flat bottom for conducting water. The guardrail is laid on its side and coupled to the pan section to form a top cover for the pan section. The guardrail has perforations to allow water to flow to said pan section.

The deck drain apparatus has a plurality of drain sections, placed end-to-end. Each of the plurality of drain sections include a pan section and an inverted W-beam section. The pan section provides a conducting surface for water. The inverted W-beam section is placed on top of the pan section to form a conduit for the water. The inverted W-beam section has perforations to allow the water to enter the conduit.

In another aspect, it is a feature of the present invention to provide a deck drain apparatus. The deck drain apparatus includes plurality of drain sections that are abuttively intercoupled to form a conduit. Each of the drain sections has a pan section and an inverted W-beam section. The pan section has a longitudinally elongated and flat conducting surface, a first perforated side, and a second perforated side. The perforated sides project upwardly along opposite lateral edges of the conducting surface. The inverted W-beam section has a first perforated wall, a first upper surface, a lower surface, a second upper surface, and a second perforated wall. The perforated walls are longitudinally elongated and formed along opposite lateral edges of the inverted W-beam section. The first upper surface is formed between first perforated wall and lower surface. The second upper surface is formed between the lower surface and the second perforated wall. The inverted W-beam section is inserted into the pan section, creating friction bonds between the first perforated side and the first perforated wall, and between the second perforated side and the second perforated wall.

In a further aspect, it is a feature of the present invention to provide a deck drain section. The deck drain section has a drain pan section and an upper section. The drain pan section has a longitudinally elongated and flat conducting surface, a first side, and a second side. The sides project upwardly along opposite lateral ends of the conducting surface. The upper section is fabricated from AASHTO M180 W-beam highway guardrail, and has alternating tabs and notches along opposite lateral edges of the upper section. The upper section is coupled to the drain pan section by friction bonds between the first side and a first one of the opposite lateral edges, and between the second side and a second one of the opposite lateral edges.

In yet another aspect, it is a feature of the present invention to provide a deck drainage system. The deck drainage system has deck drain sections laid end-to-end to form a conduit along a deck. Each of the deck drain sections has a drain pan part and an upper part. The drain pan part is longitudinally elongated, and has a flat bottom and two perforated sides. The two perforated sides project normal to the flat bottom along opposite lateral edges of the flat bottom. The upper part is fabricated from AASHTO M180 W-beam highway guardrail, and has alternating tabs and notches formed along opposite lateral ends of the upper part. The upper part is inserted into the drain pan part to form press-fit bonds between first tabs along a first one of the opposite lateral ends and a first one of the two perforated sides, and between second tabs along a second one of the opposite lateral ends and a second one of the two perforated sides.

BRIEF DESCRIPTION OF THE DRAWINGS

These and other objects, features, and advantages of the present invention will become better understood with regard to the following description, and accompanying drawings where.

DETAILED DESCRIPTION

In view of the above background on the various techniques employed to manufacture and configure deck drainage systems, a related art example will now be discussed with reference to FIG. 1. This example illustrates the problems associated with fabricating drain sections that are used to build a drainage system. In particular, present day drain sections utilize elaborate materials and/or fabrication patterns to achieve certain physical properties such as compression resistance, electrical non-conductivity, etc., thus unnecessarily driving up the total cost of a deck drainage system. Following this discussion, a detailed description of the present invention will be provided with reference to FIGS. 2 through 11. The present invention overcomes the limitations of present day deck drainage fabrication techniques by utilizing readily obtainable and inexpensive W-beam highway guardrail material as an upper portion of a deck drain section, consequently enabling builders to provide deck drainage systems at an advantageously reduced cost.

Figure 1:
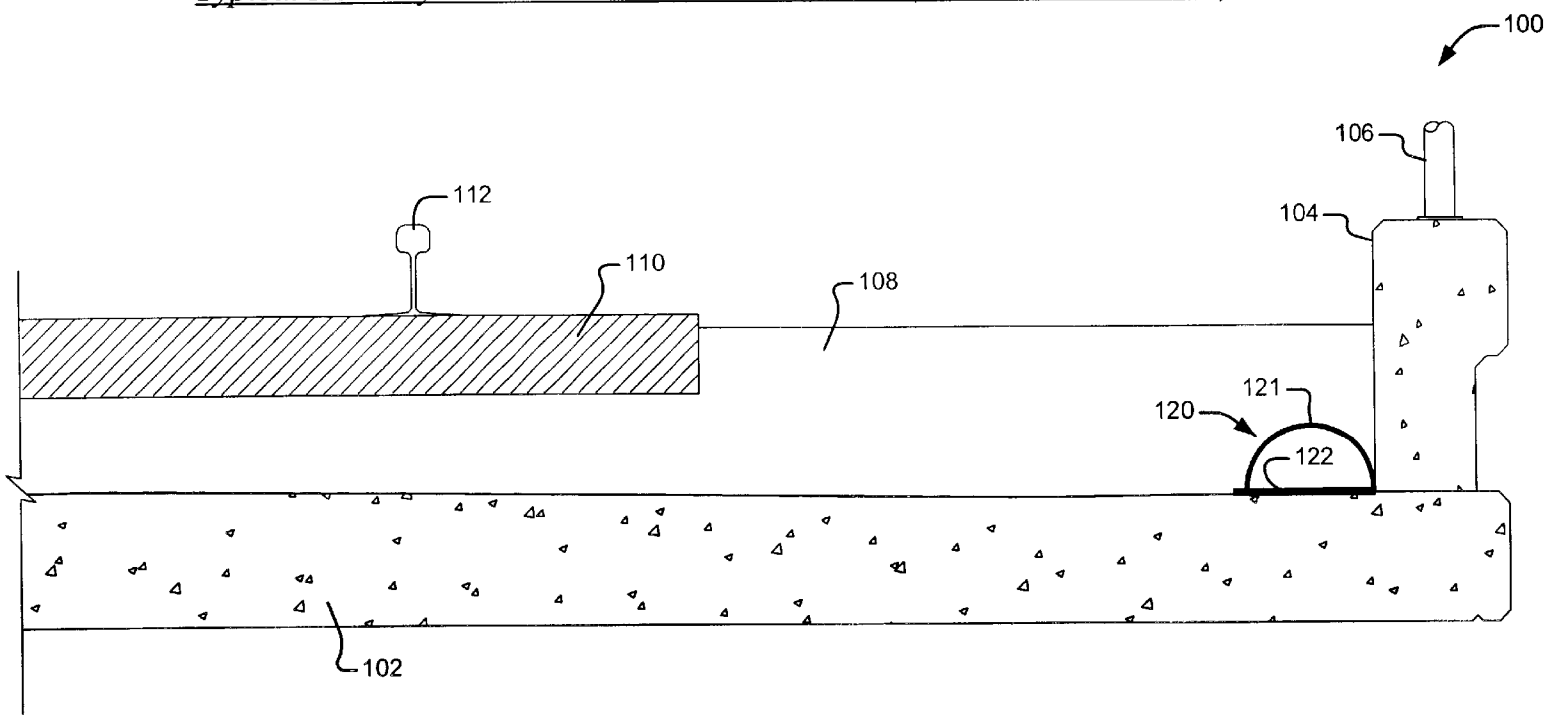
FIG. 1 (Related Art)
FIG. 1 is a diagram illustrating how a related art deck drain is configured to drain excess water away from a railway bridge deck.

Referring to FIG. 1, a diagram 100 is presented illustrating how a related art deck drain 120 is configured to drain excess water away from a railway bridge deck. The diagram 100 depicts, in cross-sectional form, a bridge deck 102 providing the foundation for a railway bridge. In a typical railway bridge design, outer lateral walls 104 are attached to the bridge deck 102 along with a railing 106. Ballast material 108 is backfilled into the cavity defined by the outer lateral walls 104 and the bridge deck 102. Railroad cross-ties 110 are seated into the ballast 108 and track rails 112 are affixed to the cross-ties 110. To provide for drainage, the bridge deck 102 is graded down slightly in the direction away from the tracks 112 and towards the outer lateral walls 104. A drainage conduit 120 is placed on the bridge deck 102 against each of the outer lateral walls 104 to collect and transport water that flows down through the ballast material 108 and away from the tracks 112.

Present day drainage conduits 120 consist of a number of drain sections ranging approximately in length from about three feet to 25 feet. The drain sections are laid end-to-end to span the longitudinal length of the bridge deck 102. Each of the sections of the drainage conduit 120 have a flat base part 122 and an arcuate upper part 121. The arcuate upper part 121 is perforated to allow water to enter the drainage conduit 120 from the ballast 108. Once inside the conduit 120, the water is transported to a downspout (not shown) or other suitable disposing means. By using the deck drain 120, builders preclude situations whereby standing or pooled water is allowed to leach into deck material 102 or even the cross-ties 110, thus causing corrosion, erosion, or other forms of degradation.

FIG. 1 illustrates only one of many applications for drainage conduits 120. One skilled in the art will appreciate that conduits 120 are used not only to drain railway decks, but also to drain other critical structures such as roadways, walkways, bridges, culverts, agricultural fields, building foundations, and the like. And although many drainage conduits 120 are buried under a ballast material 108, ballast 108 need not cover a drain 120 provided the drain 120 is oriented so that gravity causes undesired water to be routed through perforations in the upper part 121 thus enabling it to be transported away by the conduit 120.

As alluded to above, several conduit configurations have been developed over the years that provide certain desirable special-purpose characteristics. But drains 120 having these special-purpose characteristics are more expensive to procure and are more difficult to obtain, primarily because they are produced in low volume production runs. For example, Grimsley uses a costly synthetic resin material for fabrication of the base and upper parts 122, 121 of his electrically non-conductive drain 120. Fouss' foldable upper part 121 is fabricated from a corrugated plastic material having a complex and non-uniform cross-section.

Advances in the art notwithstanding, builders today cannot readily obtain inexpensive drainage system materials. In most cases, particular drainage systems are fabricated by only one manufacturer, and builders are forced to pay excessively high prices to procure drainage systems having certain characteristics that are most likely not required for the job. More often than not, what these builders require is a drainage system that is composed of sturdy, rust-resistant, readily obtainable, and inexpensive materials.

The present inventors have observed that W-beam highway guardrail is a material that possesses all of the characteristics that are needed for a significant percentage of drainage applications. W-beam guardrail is inexpensive and is readily available. Standard tooling exists for the production of W-beam guardrail. W-beam guardrail is produced by many vendors within a cost-competitive market environment. W-beam guardrail will hold up under the compressive forces of ballast 108 because it is longitudinally corrugated and is fabricated from steel having a minimum tensile strength of 70,000 psi. Moreover, galvanized W-beam guardrail is rust-resistant.

Accordingly, the present invention is provided to overcome the limited availability and cost limitations of present day deck drainage apparatus. Through the use of W-beam highway guardrail as an upper part of a deck drain section, deck drains for the more common drainage applications can be inexpensively manufactured and rapidly fielded. The present invention is more specifically discussed with reference to FIGS. 2 through 11.

Figure 2:
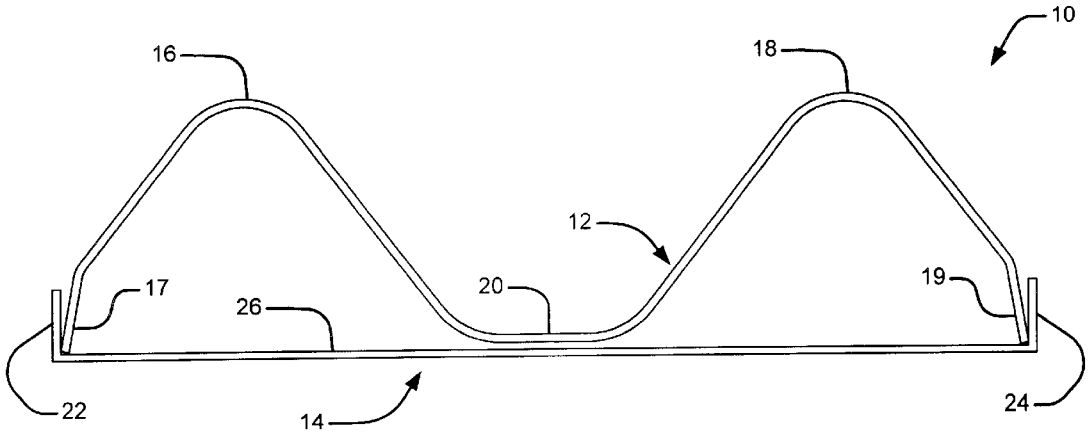
FIG. 2 is a magnified end view of the W-beam deck drain section taken along line 3—3 of FIG. 2.

Referring to FIG. 2, a W-beam deck drain section 10 in accordance with the present invention is presented. The deck drain section 10 includes a bottom part, or drain pan 14, into which is coupled an upper section, or W-beam section 12, that is fabricated from W-beam highway guardrail. W-beam highway guardrail is designated formally as Corrugated Sheet Steel Beams for Highway Guardrail by Standard Specification M180, controlled by the American Association of State Highways and Transportation Officials (AASHTO), which is herein incorporated by reference. M180 Class A W-beam guardrail is fabricated out of 10 or 12 gauge steel. M180 Class B W-beam guardrail is fabricated out of 10 gauge steel. The Standard Specification includes type provisions. for galvanized, painted, or unfinished W-beam guardrail. In one embodiment, Class A, galvanized W-beam guardrail is used to fabricated the upper section 12. In alternative embodiments, Class B galvanized guardrail material is used to fabricate the upper section 12. In above ground embodiments, the W-beam guardrail may be painted. For embodiments that lie beneath ballast material, galvanized guardrail is recommended to preclude corrosion.

The drain pan section 26 has a longitudinally elongated and generally flat conducting surface 26 and two perforated sides 22, 24. The two perforated sides 22, 24 project upward from the conducting surface 26, or flat bottom 26.

The upper section 12 is a modified section of M180 W-beam guardrail material that has two perforated walls 17, 19, two upper surfaces 16, 18, and a lower surface 20 formed therebetween. Together, the walls 17,19, upper surfaces 16, 18, and the lower surface 20 are shaped out of a flat piece of steel to form an inverted W shape. In one embodiment, the distance between the two perforated walls is approximately 12 inches. Accordingly, the drain pan section 12 is sized to provide a tight fit between the drain pan sides 22, 24 and the W-beam section walls 17, 19 when the W-beam section 12 is pressed into the drain pan section 14. As FIG. 3 most appropriately illustrates, when ballast material is backfilled above the W-beam part upper part 12, the two sides 17, 19 are caused to flex laterally outward towards the two walls 22, 24 of the drain pan section 14, thus strengthening the friction bonds created between the W-beam sides 17, 19 and the drain pan walls 22, 24. In addition, M180 W-beam guardrail is shaped so that when the inverted W-beam section 12 is pressed into the drain pan 14, there is an approximate 1/16-inch gap between the side directly opposite the lower surface 20 and the drain pan bottom 26.

Figure 3:
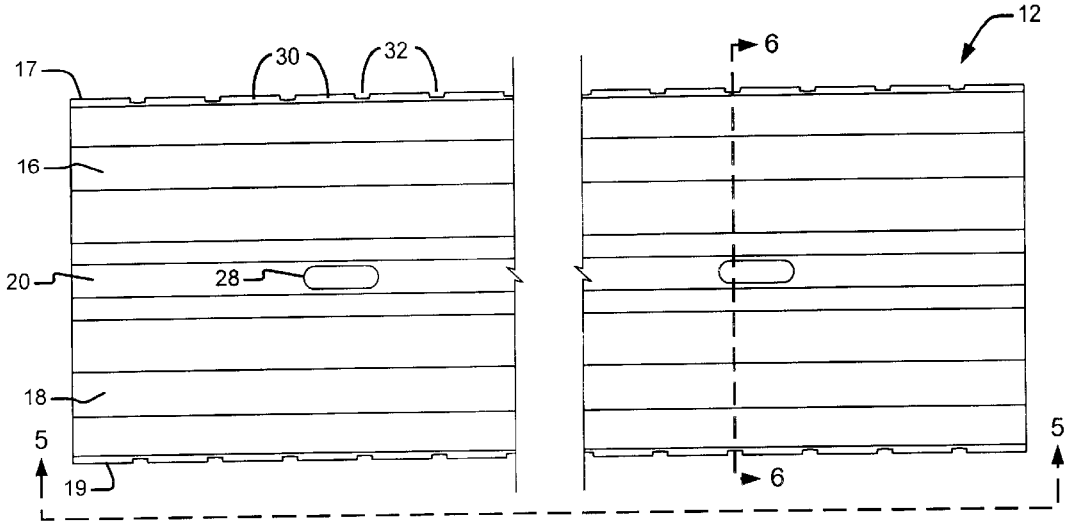
FIG. 3 is a plan view of a W-beam upper section in accordance with the present invention.
Figure 4:
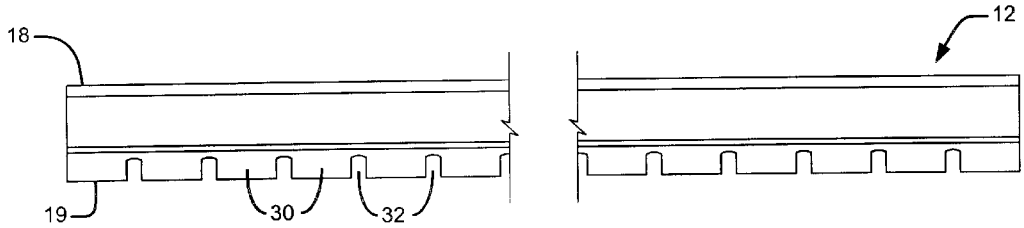
FIG. 4 is a side view of the W-beam upper section taken along line 5—5 of FIG. 4.
Figure 5:
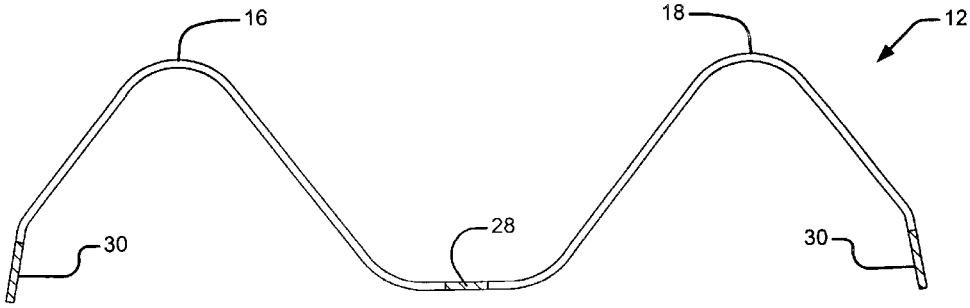
FIG. 5 is a cross-sectional view of the W-beam upper section taken along line 6—6 of FIG. 4.
Figure 6:
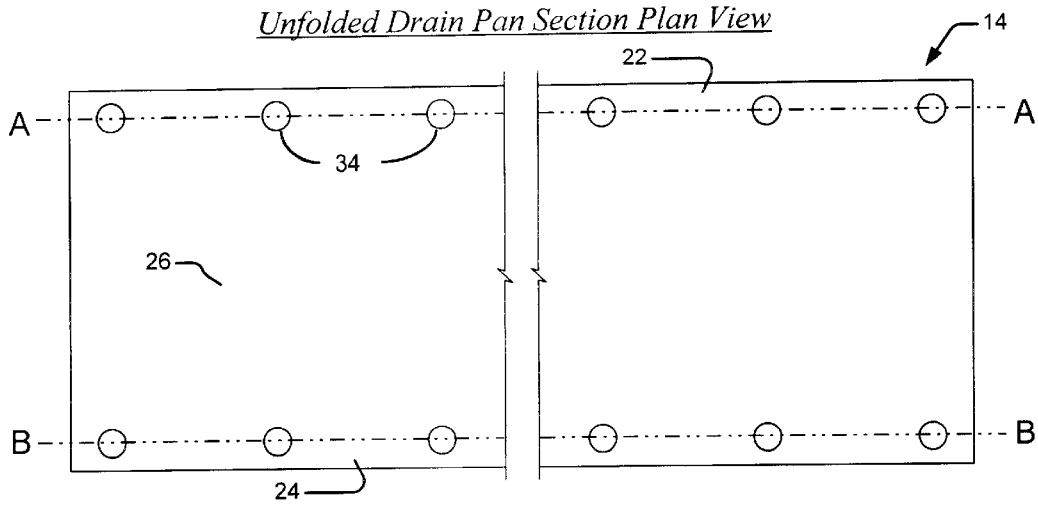
FIG. 6 is a plan view of an unfolded drain pan section according to the present invention.

Now referring to FIGS. 3 through 5, three views of a drain pan section 12 according to the present invention are presented: a plan view (FIG. 3), a side view (FIG. 4) taken along line 5—5 of FIG. 3, and a magnified cross-sectional view (FIG. 5) taken along line 6—6 of FIG. 3. FIG. 4 illustrates slots 28 that are cut into the lower surface 20 in accordance with Specification M180. The slots provide a channel for water to pass from ballast material directly above the lower surface 20 into the conduit section 10. The views also illustrate a series of alternating tabs 30 and notches 32 that are formed along each of the two walls 17, 19. Both of the walls 17, 19 of a W-beam guardrail section are notched to provide paths for water entry into the conduit channel through the perforated sides 22, 24 of the drain pan 14. Notching in each of the walls 17, 19 of the W-beam form alternating tabs 30 that ease installation of the W-beam section 12 into the drain pan 14. The tabs 30 flex much easier than would an otherwise solid wall surface. In one embodiment, the notches 32 are cut longitudinally into the W-beam walls 17, 19 at approximately 2.5-inch intervals. In an alternative embodiment, the notches 32 are approximately 0.5-inch by 0.5-inch cuts.

Figure 7:
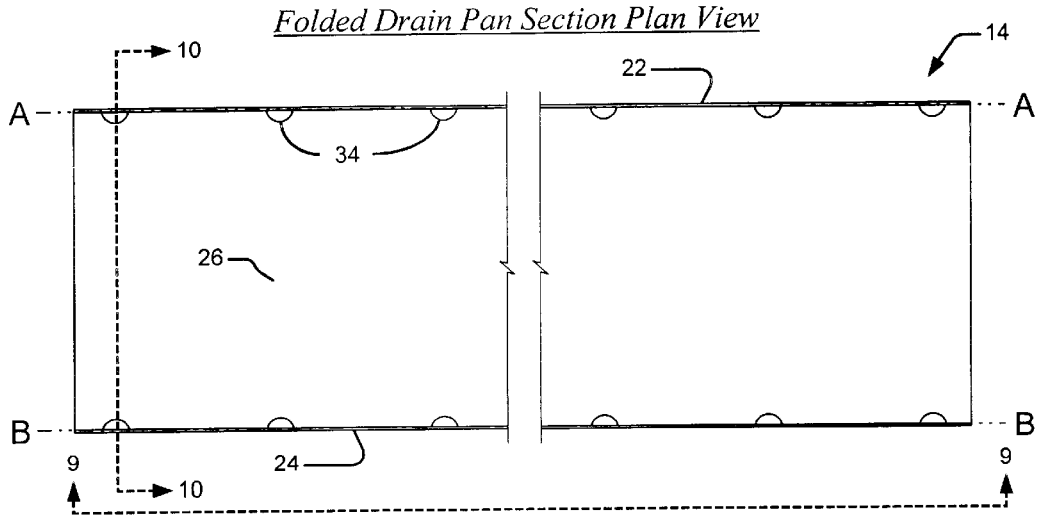
FIG. 7 is a plan view of the drain pan section featuring sides formed by folding along lines A—A and B—B of FIG. 7.
Figure 8:
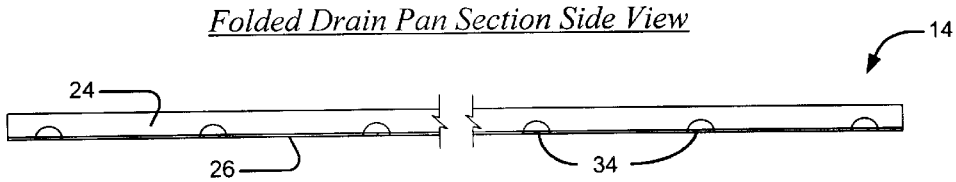
FIG. 8 is a side view of the folded drain pan section taken along line 9—9 of FIG. 7.
Figure 9:
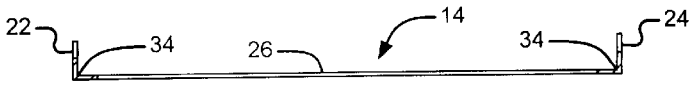
FIG. 9 is a cross-sectional view of the folded drain pan section taken along line 10—10 of FIG. 8.

Now referring to FIGS. 6 through 9, four views of an inverted W-beam upper section 14 according to the present invention are presented: a plan view featuring the sides 22, 24 of the drain pan 14 prior to folding (FIG. 6), a plan view after the sides 22, 24 have been folded (FIG. 7), a side view (FIG. 8) taken along line 9—9 of FIG. 7, and a magnified cross-sectional view (FIG. 9) taken along line 10—10 of FIG. 7. The views specifically feature two perforation patterns that are fabricated along longitudinal transverse axes of the drain pan section 14 that are defined by the intersection of the conducting surface 26 and one of the sides 22 and by the intersection of the conducting surface 26 and the other side 24. In one embodiment, the drain pan 14 contains perforations 34 approximately one inch in diameter. The perforations are spaces roughly six inches apart from center to center, and folding axes (i.e., lines A—A, and B—B) are located approximately one inch from the lateral edges of the unfolded pan. Hence, in the noted embodiment, the folded drain section 14 depicted in FIGS. 8–10 comprises sides 22, 24 of approximately 1-inch in height that provide roughly 0.4 square inches of cross section for water flow through each perforation 34. In addition, pan bottom 26 provides roughly the same area through each perforation 34 for water entry. Furthermore, the axes of perforation A—A, B—B establish a natural hinging mechanism whereby the sides 22, 24 can be easily folded. In one embodiment, the drain pan section 14 is galvanized and is fabricated 12 gauge steel. In an alternative embodiment, 10 gauge steel is used.

Figure 10:
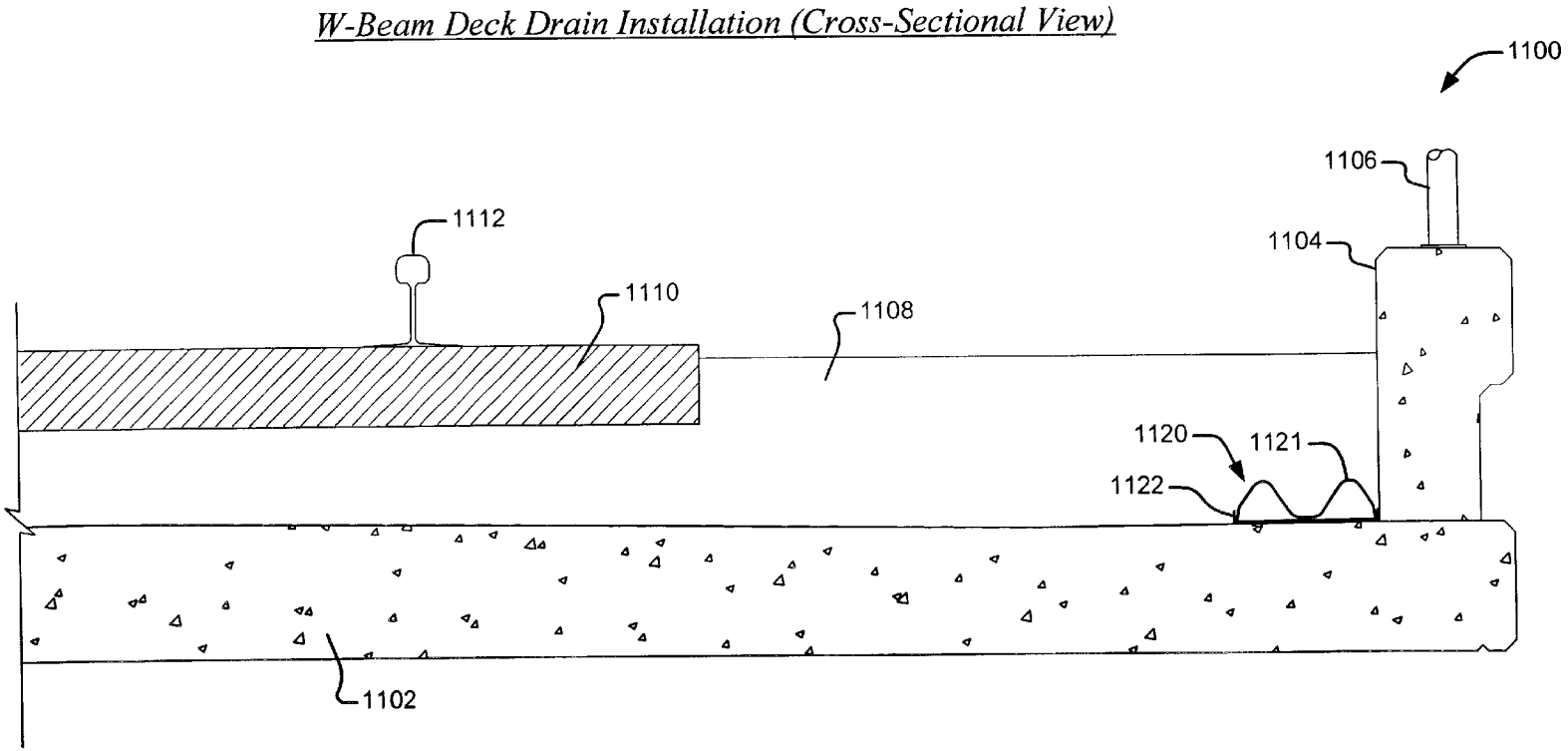
FIG. 10 is a diagram illustrating how a W-beam deck drain according to the present invention is configured to drain excess water away from a railway bridge deck.

Now referring to FIG. 10, a diagram 1100 is presented illustrating how a W-beam deck drain 120 according to the present invention is configured to drain excess water away from a railway bridge deck. The diagram 1100 depicts, in cross-sectional form, a bridge deck 1102 providing the foundation for a railway bridge. Outer lateral walls 1104 are attached to the bridge deck 1102 along with a railing 1106. Ballast material 1108 is backfilled into the cavity defined by the outer lateral walls 1104 and the bridge deck 1102. Cross-ties 110 are seated into the ballast 1108 and track rails 1112 are affixed to the cross-ties 110. To provide for drainage, the bridge deck 1102 is graded down slightly in the direction away from the tracks 1112 and towards the outer lateral walls 1104. A drainage conduit 1120 according to the present invention is placed on the bridge deck 1102 against each of the outer lateral walls 1104 to collect and transport water that flows down through the ballast material 1108 and away from the tracks 1112.

In one embodiment, a deck drainage system according to the present invention is configured by abuttively intercoupling a number of individual drain sections in a longitudinal configuration corresponding to the length of the deck 1102. In one embodiment, 10-foot sections 1120 are butted together to span the length of the deck. In an alternative embodiment, the sections 1120 are butted together on a mastic material (not shown) such as conventional tar that is typically used to seal the deck 1102 prior to backfilling with ballast 1108. In an embodiment that couples to a downspout (not shown), one of the drain pan sections 1122 is perforated with a 6-inch diameter hole to provide a means for dumping water into the downspout. Alternative embodiments consist of upper sections 1121 and drain pan sections 1122 cut to differing lengths, where two or more upper parts 1121 overlap within a single drain pan part 1122 or where two or more drain pan parts 1122 are coupled to a single w-beam upper part 1121.

As FIGS. 2 through 10 clearly illustrate, used of the present invention enables builders to easily an inexpensively configure deck drains for any number of applications. In contrast to the more esoteric shapes and materials discussed above with reference to present day deck drains, deck drainage systems according to the present invention can be obtained from any number of sources without incurring tooling costs. Alternative sources of manufacture are already in place to accommodate surge conditions and a standard already exists for manufacture of one of the elements of the deck drain system.

Those skilled in the art should appreciate that they can readily use the disclosed conception and specific embodiments as a basis for designing or modifying other structures for carrying out the same purposes of the present invention without departing from the spirit and scope of the invention as defined by the appended claims.

What is claimed is:

1. A deck drain apparatus, comprising:

a plurality of drain sections, placed end-to-end to form a conduit, each of said plurality of drain sections comprising:

a pan section, having a longitudinally elongated and flat conducting surface, a first perforated side, and a second perforated side, said perforated sides upwardly projecting along opposite lateral edges of said conducting surface; and an inverted W-beam section, having a first perforated wall, a first upper surface, a lower surface, a second upper surface, and a second perforated wall, said perforated walls being longitudinally elongated and formed along opposite lateral edges of said inverted W-beam section, said first upper surface formed between said first perforated wall and said lower surface, said second upper surface formed between said lower surface and said second perforated wall;

wherein said inverted W-beam section is inserted into said pan section, creating friction bonds between said first perforated side and said first perforated wall, and between said second perforated side and said second perforated wall.

2. The deck drain apparatus as recited in claim 1, wherein said plurality of drain sections are fabricated from galvanized steel.

3. The deck drain apparatus as recited in claim 1, wherein said W-beam section is fabricated from AASHTO M180 W-beam highway guardrail.

4. The deck drain apparatus as recited in claim 3, wherein said AASHTO M180 W-beam highway guardrail is fabricated from 10 or 12 gauge steel (Class A) and is galvanized (Type 2).

5. The deck drain apparatus as recited in claim 4, wherein said pan section is perforated along axes defined by the intersection of said first perforated side and said flat conducting surface and by the intersection of said second perforated side and said flat conducting surface.

6. The deck drain apparatus as recited in claim 5, wherein perforations along said axes are approximately 1 inch in diameter and wherein said perforations are spaced along each of said axes at approximately 6-inch intervals.

7. The deck drain apparatus as recited in claim 4, wherein said first and second perforated walls each comprise a plurality of alternating tabs and notches, said notches being spaced at approximately 2.5-inch intervals.

8. The deck drain apparatus as recited in claim 7, wherein said tabs flex to allow said inverted W-beam upper section to be inserted into said pan section.

9. A deck drain section, comprising:

a drain pan section, having a longitudinally elongated and flat conducting surface, a first side, and a second side, said sides projecting upwardly along opposite lateral ends of said conducting surface; and an upper section, fabricated from AASHTO M180 W-beam highway guardrail, having alternating tabs and notches along opposite lateral edges of said upper section;

wherein said upper section is coupled to said drain pan section by friction bonds between said first side and a first one of said opposite lateral edges, and between said second side and a second one of said opposite lateral edges.

10. The deck drain section as recited in claim 9, wherein said AASHTO M180 W-beam highway guardrail is fabricated from 12 gauge steel (Class A) and is galvanized (Type 2).

11. The deck drain section as recited in claim 9, wherein said drain pan section is fabricated from 10 or 12-gauge steel.

12. The deck drain section as recited in claim 11, wherein said drain pan section is galvanized.

13. The deck drain section as recited in claim 9, wherein said drain pan section is perforated along axes defined by the intersection of said first side and said flat conducting surface and by the intersection of said second side and said flat conducting surface.

14. The deck drain section as recited in claim 13, wherein perforations along said axes are approximately 1 inch in diameter and wherein said perforations are spaced at approximately 6-inch intervals along said axes.

15. The deck drain section as recited in claim 9, wherein said notches are longitudinally spaced along said opposite lateral edges at approximately 2.5-inch intervals.

16. The deck drain section as recited in claim 15, wherein said tabs flex to allow said inverted W-beam upper section to be coupled to said drain pan section.

17. A deck drainage system, comprising:

deck drain sections laid end-to-end to form a conduit along a deck, each of said deck drain sections comprising:

a drain pan part, said drain pan part being longitudinally elongated, and having a flat bottom and two perforated sides, said two perforated sides projecting normal to said flat bottom along opposite lateral edges of said flat bottom; and an upper part, fabricated from AASHTO M180 W-beam highway guardrail, having alternating tabs and notches formed along opposite lateral ends of said upper part;

wherein said upper part is inserted into said drain pan part to form press-fit bonds between first tabs along a first one of said opposite lateral ends and a first one of said two perforated sides, and between second tabs along a second one of said opposite lateral ends and a second one of said two perforated sides.

18. The deck drainage system as recited in claim 17, wherein said AASHTO M180 W-beam highway guardrail is fabricated from 10 or 12 gauge steel (Class A) and is galvanized (Type 2).

19. The deck drainage system as recited in claim 17, wherein said drain pan part is fabricated from 12-gauge steel.

20. The deck drainage system as recited in claim 19, wherein said drain pan part is galvanized.

21. The deck drainage system as recited in claim 17, wherein-said drain pan part has perforations along axes defined by the intersection of said first one of said two perforated sides and said flat bottom and by the intersection of said second one of said two perforated sides and said flat bottom.

22. The deck drainage system as recited in claim 21, wherein said perforations are approximately 1 inch in diameter and wherein said perforations are longitudinally spaced at approximately 6-inch intervals along said axes.

23. The deck drainage system as recited in claim 17, wherein said tabs are longitudinally spaced along each of said opposite lateral ends at approximately 2.5-inch intervals.

24. The deck drainage system as recited in claim 23, wherein said tabs flex to allow said upper part to be inserted into said drain pan part.

* * * * *